United States Patent [19]

Arnold

[11] 4,381,532

[45] Apr. 26, 1983

[54] CONSTANT ENERGY DRIVE CIRCUIT FOR ELECTROMAGNETIC PRINT HAMMERS

[75] Inventor: Robert W. Arnold, Glen Aubrey, N.Y.

[73] Assignee: International Business Machines Corporation, Armonk, N.Y.

[21] Appl. No.: 274,933

[22] Filed: Jun. 18, 1981

[51] Int. Cl.[3] ..... H01H 47/32

[52] U.S. Cl. ..... 361/154; 361/152

[58] Field of Search ..... 361/152, 153, 154

[56] References Cited

U.S. PATENT DOCUMENTS 3,789,272 1/1974 Vollhardt ..... 361/154

4,048,665 9/1977 Lia et al. ..... 361/152

OTHER PUBLICATIONS

IBM Technical Disclosure Bulletin, vol. 22, No. 8A, Jan. 1980, "Controller of Electromechanical Printhammer," Greer et al., pp. 3294, 3295.

*Primary Examiner*—Reinhard J. Eisenzopf

*Attorney, Agent, or Firm*—John S. Gasper

[57] ABSTRACT

A constant energy drive circuit for an electromagnetic print hammer has a chopping circuit including a comparator which cycles a switch connecting the energizing coil of the print hammer to an unregulated power supply. Changes in the drive voltage of the unregulated source are compensated for by altering the switching rate of the switch by adjusting the amplitude of a reference signal applied to the comparator. The reference signal adjustment is inverse to changes in the drive voltage.

13 Claims, 5 Drawing Figures

CONSTANT ENERGY DRIVE CIRCUIT FOR ELECTROMAGNETIC PRINT HAMMERS

Control of hammer motion is of crucial importance to print quality. In using the energization of a coil to effect printing action, it is highly desirable to be able to apply the same total amount of energy to the coil every time it is energized. This guarantees that the hammer will impact the print medium and type at a constant force and assures stability in the control of the flight time of the print hammer so that impact can occur precisely at the instant of alignment of a desired type character with a selected print hammer. It is also desirable to be able to apply constant energy every time to the coil without using a costly regulated power source and control circuitry. It is further desirable to be able to achieve these objectives in a hammer control system in which the hammer driver circuitry is always activated i.e. turned on, for the same time duration. This eliminates the need for the circuit complexity associated with other controls that vary amplitude and/or pulse width of the energizing signal direction applied to the coil. It is desirable that the constant energy level can be easily varied to take into account different forms thicknesses used in printing. A number of techniques have been used in the prior art to achieve precision hammer control.

U.S. Pat. No. 3,789,272, issued Jan. 29, 1974 to D. Vollhardt, shows a triggering circuit for a plurality of printing solenoids which alters the duration of the actuating pulses as an inverse function of the supply voltage.

U.S. Pat. No. 4,048,665, issued Sept. 13, 1977 to B. Lia et al., shows a driver circuit for a printer electromagnet where the circuit operates with an unregulated supply voltage by providing energizing current pulses whose level and duration are dependent on the present level of the supply voltage. IBM Technical Disclosure Bulletin, Vol. 22, No. 5, October 1979, Pgs. 1979 et seq describes a print control circuit in which the pulse width is modified to compensate for rise time fluctuations due to variations in voltage supply.

U.S. Pat. No. 3,549,955, issued Dec. 22, 1970 to T. O. Paine, shows a drive circuit for an inductive load in which driving voltage is supplied to a solenoid until the solenoid current exceeds a high pull-in current. Then the circuit automatically terminates the driving voltage and the current in the solenoid is permitted to decay to a value just exceeding drop out current. The circuit then chops the drive current continuously at a level just above drop out current but considerably below pull-in current. No provision is made for compensating variations in supply voltage.

U.S. Pat. No. 4,107,593, issued Aug. 15, 1978 to E. G. Anderson, shows an electronic circuit for controlling the energization of the windings of a stepper motor which utilizes a chopping circuit. No means is shown for altering the chopping rate based on fluctuations in an unregulated power supply.

U.S. Pat. No. 4,059,844, issued Nov. 22, 1977 to J. W. Stewart, describes a solenoid drive circuit for wire printers in which a transistor switch connects a solenoid to a high voltage source to activate the solenoid quickly. The switch is cycled in response to the current level in the solenoid to disconnect the source from the solenoid for fixed periods of time to maintain the level of current in the solenoid below a selected level. IBM Technical Disclosure Bulletin of January 1980, at pp. 3163 et seq, Vol. 22, No. 8A, describes a current controller for coils of a stepping motor or hammers which uses current chopping to limit current level in the coil. There is no discussion relating to compensation for drive voltage variation. A comparison is made of the voltage of a charging capacitor and a reference voltage to turn off the driver circuitry when voltage equality occurs.

The drive circuit of this invention provides a coil connectable by a controlled switch to an unregulated source of drive voltage which energizes the coil with a rapidly rising current. The switch is always enabled to energize the coil for a fixed on-time interval. At a preset level of the rising current after the switch is enabled, a chopper circuit is activated which then cycles the switch between closed and open states for the remainder of the interval. The total energy applied to the coil is held constant inspite of expected changes in the drive voltage without altering the length of the on-time interval simply by altering the switching rate in such a manner that the average peak current in the coil during the chopping portion of the interval is adjusted to compensate for changes in the drive voltage. Specifically a reference voltage derived from the drive voltage is applied to a voltage divider resistance network which establishes the threshold levels of a reference signal applied to a comparator. The comparator generates cycling signals for cycling the switch means by comparing a current sense signal with the reference signals. A feedback circuit from the output of the comparator includes a threshold switch transistor and a branch resistance of the network. The same cycling signals from the comparator used for cycling the power switch are applied to the feedback transistor to cyclically vary the network resistance and hence the reference signal threshold levels. The average peak current in the coil is varied to compensate for voltage changes by varying the reference voltage applied to the resistance network. An operational amplifier connected as a series regulator varies the reference voltage inversely with changes in the drive voltage. Regulating the reference voltage greatly simplifies circuitry employed for regulating the drive voltage. Using the cycling signals to switch the threshold levels of the reference signal provides more accurate and more rapid chopping of the current in the coil. Because the coil is always energized for a fixed interval, the complexity associated with controlling coil energy by varying time intervals has been avoided.

The above as well as other objects and advantages will become further apparent from the following description as seen in the drawings in which FIG. 1 is a schematic circuit diagram showing one part of the drive circuit of the invention.

Figure 1:
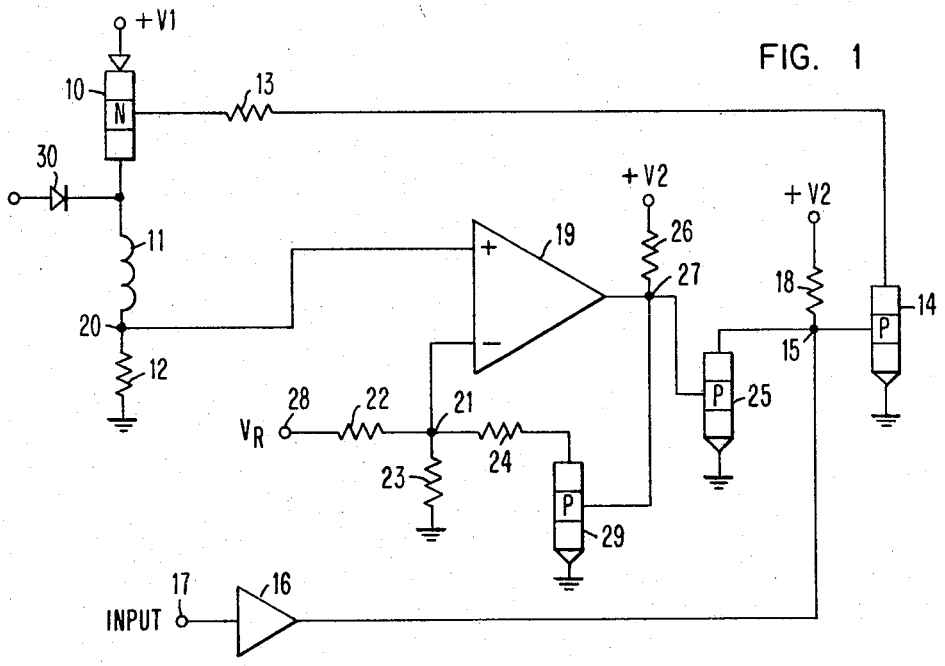

As seen in FIG. 1, the drive circuit of this invention includes a series path comprising switch transistor 10 coil 11 and load resistor 12 with the emitter of transistor 10 connected to drive voltage +V1 of an unregulated power supply and with load resistor 12 connected to ground. The base of switch transistor 10 is connected for switching purposes via resistor 13 to the collector of a second switch transistor 14 having a grounded emitter and a base connected at junction 15 to an inverter 16 which receives the input turn-on signal applied by an external source such as a printer control to terminal 17. Resistor 18 connected to junction 15 and to bias voltage +V2 sets the switching voltage level of transistor 14.

Comparator 19 functions to compare a current sense signal indicative of the current level in coil 10 with a reference signal indicative of the desired current levels in coil 10 at which the switch transistors 10 and 14 are cycled so as to control chopping of the current in coil 11. Comparator 19 has a plus input connected to junction 20 between load resistor 12 and coil 11 and a − input connection to junction 21 of a resistance network consisting of resistors 22, 23 and 24. The output of comparator 19 is connected to the base of transistor 25 having a grounded emitter and a collector connection to junction 15. Transistor 25 functions essentially as an inverter of cycling signals generated by comparator 19. Resistor 26 is connected to the output of comparator 19 at junction 27 and to the same bias voltage +V2 and controls the gating level of transistor 25.

The current sense signal indicative of the level of current in coil 11 is determined by the voltage at junction 21 which is directly related to the current through load resistor 12 from coil 11 to ground when transistor 10 is enabled, i.e. switched to the closed state, by switch transistor 14.

The reference signal is preferably a voltage representing the desired level of current in coil 11 at the junction 21 determined by a reference voltage $V_R$ applied at terminal 28 and the voltage drop produced the combined resistance of resistors 22, 23 and 24. Resistors 22 and 23 essentially function as a voltage divider which determines the voltage drop from $V_R$ to ground. Resistor 24 is a branch resistor which is part of a feedback circuit from comparator 19 to enable the total resistance of the network to be cycled between upper and lower levels to raise or lower the reference threshold voltage at junction 21. Specifically, branch resistor 24 is connected in series to the collector of the threshold switch transistor 29 having a grounded emitter with a base connection at junction 27 in the output of comparator 19. Cyclic signals 29 by comparator 19 at junction 27 cyclically switches transistor 29 thereby cyclically grounding resistor 24 so that the resistance level of the resistance network cycles between upper and lower levels. This in turn produces a cycling of the threshold voltage at junction 21 to the − input to comparator 19. Cycling signals generated by comparator 19 at junction 27 are at the same time inverted by transistor 25 and applied to transistor 14 at junction 15 to open and close transistor 10 when an input turn-on signal is generated through inverter 16 to cause cycling of the connection of coil 11 to the unregulated drive voltage +V1. This produces current chopping between levels set by the threshold voltages at junction 21 to the − input of comparator 19. In this manner, the average peak current value in coil 11 can be controlled during the chopping portion of the time duration of the input turn-on signal.

The operation of the circuit in FIG. 1 is as follows:

When the input signal is up (as during the period when no hammer firing is intended) inverter 16 applies a down signal to junction 15 holding transistor 14 off independently of the state of transistor 25. This in turn holds transistor 10 in open state thereby disconnecting coil 11 from the power supply voltage +V1. With no current in coil 11, a 0 volt current sense signal appears at the + input of comparator 19. Under this condition, the output of comparator 19 is at 0 volts. With 0 volts output from comparator 19, transistor 29 in the feedback circuit is open producing a high threshold voltage at junction 21 to the − input of comparator 19. When the input signal goes down (for example to fire the print hammer) inverter 16 produces an up signal at junction 15 and since transistor 25 is also off a voltage appears at junction 15 turning on transistor 14 which enables transistor 10 to connect coil 11 to the drive voltage +V1 of the unregulated power supply. Coil current rises rapidly in accordance with the following expression.

$$V1/R(1-e^{-(R/L)t})$$

where R equals the sum of the resistances of coil 11 and resistor 12.

When the coil current reaches the level at which the voltage at junction 20 equals the preset threshold level at junction 21, a positive voltage appears at junction 27 switching transistor 25 on to open switch transistor 14 which switches transistor 10 to the open state. The positive voltage signal from comparator 19 at junction 27 also causes transistor 29 to ground resistor 24 in parallel with resistor 23. This reduces the total network resistance and causes a lower threshold voltage to appear at junction 21 to the − input of comparator 19.

With coil 11 disconnected due to the open state of transistor 10, the current in coil 11 decays through clamping diode 30 connected to a suitable circuit in accordance with the following well known expression.

$$i=4.14e^{-(R/L)t}$$

When the current level in coil 11 reaches a level where where the voltage at junction 20 equals the lower threshold voltage at junction 21 comparator 19 applies an output signal which goes down opening both transistors 29 and 25. Since the INPUT signal at terminal 17 is still present in a down condition, transistor 14 is again switched by the up signal at junction 15 enabling switch 10 to the closed state thereby connecting the drive voltage +V1 to coil 11. This causes current to rise toward the peak threshold level. With transistor 29 open branch resistor 24 has been disconnected from ground and the threshold voltage at junction 21 has been restored to the upper level set by the reference voltage $V_R$ in combination with resistors 22 and 23 connected as a voltage divider to ground. When the current level again reaches the upper threshold value, an up signal from comparator 19 is again applied at junction 27 to open switch transistor 10 and close threshold transistor 29 again respectively disconnecting coil 11 from +V1 and reducing the threshold resistance and consequently the threshold voltage causing the current in coil 11 to again decay toward the lower threshold level.

Figure 4:
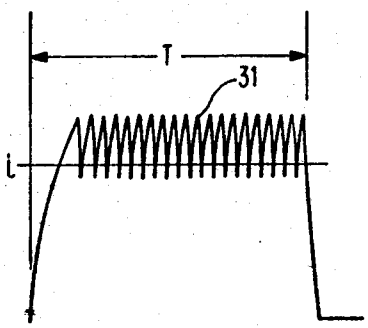

The process of chopping or oscillating the current in coil 11 continues so long as the INPUT signal remains down. When the INPUT signal comes up, which in accordance with this invention always occurs at the end of a fixed time duration, transistor 14 regardless of its state is gated off causing transistor 10 to be or remain opened thereby causing current to begin or to continue decaying toward a 0 value. Comparator 19 continues to function in accordance with the sense and reference threshold voltages until the sense and threshold compare produces a down level signal at junction 27. Transistors 25 and 29 will remain or are restored to open condition; however, transistor 14 will not change state but resistor 24 being disconnected from ground raises the reference threshold voltage at the − input of comparator 19 to the upper level in preparation for the next fixed time duration application of the INPUT signal to terminal 17. The operation just described is seen in the current trace of FIG. 4 in which curve 31 represents the current in coil 11 and T is the duration of the input signal. A specific circuit from which the curves were generated contained circuit elements having the following parameters.

| | |
|---|---|
| 1. | Resistors |
| | 12 - .5Ω |
| | 13 - 1.2K |
| | 18 - 1.5K |
| | 22 - 4.7K |
| | 23 - 4.7K |
| | 24 - 5.1K |
| | 26 - 2K |
| 2. | Coil 11 262 turns - R = 6.1Ω L = 2.2MH |
| 3. | Transistors |
| | 10 - RCA 8203 B |
| | 14 - 2N719 A (Texas Instrument) |
| | 16 - 5N7405 (Texas Instrument) |
| | 25 - 2N2453 (Texas Instrument) |
| | 29 - 2N2453 (Texas Instrument) |
| 4. | Voltages |
| | V1 - +48V |
| | V2 - +5V |
| | $V_R$ - 4.14V (Nominal) |

A comparator 19 useful in practicing the invention is the LM339 described on page 5–29 and discussed on that page and subsequent pages through page 5–36 in the National Linear Data Book, copyrighted 1976 by National Semiconductor Corp. The + input the − input and the output of the comparator 19 of FIG. 1 correspond with the +, − and OUTPUT terminals shown on page 5–29 for the illustrated dual-in-line and flat package circuit diagram. Comparator circuits of equivalent or other design may also readily be used by persons having ordinary skill for practicing this invention.

Figure 2:
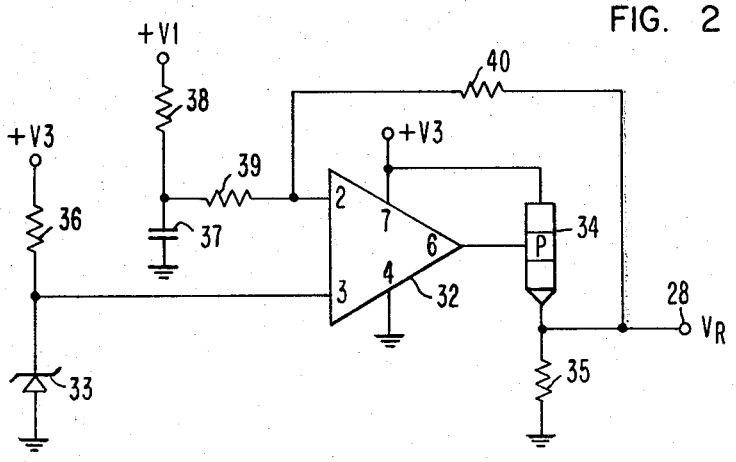
FIG. 2 is a schematic circuit diagram showing the second part of the drive circuit of the invention which is combined with FIG. 1.

FIG. 2 shows the circuit for supplying $V_R$ to the resistance network of FIG. 1 at terminal 28. Essentially the circuit of FIG. 2 is a series regulator comprising an operational amplifier 32 whose output is derived from the zener diode 33 and the unregulated power supply voltage V1. Transistor 34 provides added current drive for use with multiple hammer devices. Resistor 35 provides such current in the event the circuit is not loaded externally. Zener diode 33 with bias resistor 36 serves as a stable voltage reference to the in phase input of operational amplifier 32. Capacitor 37 and resistor 38 provide filtering of the supply voltage. Resistor 39 insures loop stability as determined by the Nyquist stability criterion. Resistor 40 in the feedback circuit from the emitter part of transistor 34 to the − input of operational amplifier which functions to invert the output of operational amplifier 32; that is, changes in the drive voltage V1 result in change of $V_R$ which are inversely proportional.

The following expression defines the operation of the circuit $$V_R = V_Z\left(1 + \frac{R_f}{R_i}\right) - \frac{R_f}{R_i} V1$$

where $V_Z$ is the voltage fixed by zener diode 33. $R_f$ is the resistance of resistor 40 and Ri is the combined resistance of resistors 38 and 39. For a nominal value of +V1=48 V, $V_R$ has a value of 4.141 volts using the following resistance parameters.

| | |
|---|---|
| 35 - 1K | $V_3$ = 8.5V |
| 36 - .24K | |
| 38 - 36K | |
| 39 - .15K | |
| 40 - 1.6K | |

Capacitor 37 has a capacitance of 6.8 μF. A suitable operational amplifier 32 is Fairchild μA741CN described in Signetics Analog Data Manual, 1979, pp. 70–76. Numerals shown for operational amplifier 32 correspond with terminals of the circuit described on pg. 70.

Other values of $V_R$ and V1 are as follows:

V1=52.8 V; $V_R$=3.9286 V

V1=43.2 V; $V_R$=4.3535 V

Figure 3:
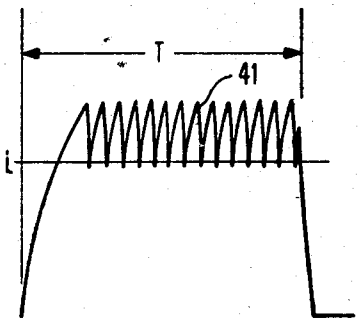

As previously stated in accordance with the invention, the threshold levels of the reference signal $V_R$ are compensated inversely with changes in the drive voltage V1. This in turn produces a shift inversely in the average current during the chopping interval. As seen in FIG. 3 where the drive voltage V1=43.2, curve 41 shows the chopping levels raised above the levels of curve 31 of FIG. 4 with a corresponding increase in the average current. It is also noted that the chopping rate has also been changed reflecting a variation in the switching rate of transistors 13 and 14 of the circuit in FIG. 1. Without the inverse compensation of $V_R$ provided by the circuit of FIG. 2, the lower drive voltage V1 would produce a slower rise time and slower chopping over a shorter interval compared with FIG. 4. Since the INPUT signal has a fixed time duration T, the net result where V1 is lower than nominal would be less energy supplied to coil 11 with consequent reduction in energy supplied to an associated print hammer. This in turn alters the input force and flight time producing poor registration and print quality. With the inverse compensation of $V_R$ provided by the circuit of FIG. 2, the amount of energy supplied to coil 11 is essentially the same thereby causing impact force level and flight time to be essentially constant.

Figure 5:
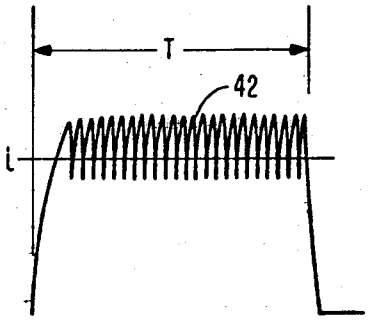
FIGS. 3–5 are graphs illustrating drive currents in the coil of an electromagnetic print hammer for three different drive voltages applied to the drive circuit of FIGS. 1 and 2.

The same result is achieved for an increase in drive voltage V1. In FIG. 5, where V1 has increased and $V_R$ has been decreased, curve 42 shows chopping occurring at proportionally lower levels and at a more rapid rate compared to curves 31 and 41 in FIGS. 4 and 3. Also, chopping occurs over a longer interval. Nevertheless, the average current produced during chopping has been lowered to the degree necessary to maintain the total energy during the fixed time duration T of the INPUT signal. In all three cases it is further noted that the peak differential of the chopped portion of the current is essentially unchanged.

Thus it is seen that a reliable, closely controlled and efficient drive circuit useful in high speed print hammers has been provided. With the circuit described a single series regulator is provided instead of regulating the entire power supply. In multiple hammer printers, when hammers are operated individually a single regulator circuit can be used for supplying a common $V_R$ so that all hammers experience the same compensation and adjustment in the chopping rate.

I claim:

1. A constant energy drive circuit for an electromagnet having a coil connectable to an unregulated source of drive voltage by a switch means activated by a turn on signal of fixed time duration causing current to flow in said coil, and a chopping circuit means for cycling said switch means activatable at a preset level of current in said coil during said time duration for chopping the current in said coil during said time duration at an average peak current for at least a portion of the remainder period of said time duration, characterized by, said chopping circuit including means for altering the switching rate of said switch means in response to changes in said drive voltage to vary the average peak current in said coil during said remainder period to compensate for changes in the drive voltage of said source.

2. A constant energy drive circuit in accordance with claim 1 in which said average peak current is varied inversely in response to changes in said drive voltage.

3. A constant energy drive circuit in accordance with claim 2 in which said chopping circuit means includes a comparison means for comparing a current level signal from said coil with a reference level signal for cycling said switch means, and said means for altering the switching rate of said switch means includes means connected to said source of drive voltage for altering said reference level signal.

4. A constant energy drive circuit for an electromagnet comprising an inductive coil, switch means having an open and a closed state for operatively connecting an unregulated source of drive voltage in circuit with said coil, current sense means for providing a sense signal indicative of the level of current in said coil, reference signal means associated with said source of drive voltage for providing a threshold signal the level of which establishes the threshold level of current in said coil, means for enabling said switch means to a closed state in response to a turn on signal of fixed time duration representing the total time for energizing said coil, chopping circuit means for cycling said switch means between said open and closed states including means for generating cycling signals in response to periodically occurring correspondence between said sense and reference signals, means responsive to said cycling signals from said chopping circuit means for cycling said level of said threshold signals from said reference signal means to said chopping circuit means, and means associated with said reference signal means for changing the amplitude levels of said threshold signals inversely in response to changes in said drive voltage.

5. A constant energy drive circuit in accordance with claim 4 in which said means for generating said cycling signals comprises a comparator circuit for comparing said sense and reference signals, and said means for cycling said level of said threshold signals comprises resistor means switchable between two resistance levels in response to said cycling signals from said comparator circuit for developing upper and lower threshold signals representing upper and lower current levels in said coil produced by said chopper circuit.

6. A constant energy drive circuit in accordance with claim 5 in which said current sense means is a load resistor in the circuit of said coil and said sense signal is a sense voltage developed across said resistor, said reference signal means includes circuit means connected with said source of drive voltage for supplying a reference voltage related to said drive voltage to said switchable resistor and said threshold signals are threshold voltages, said comparator circuit is a voltage comparator for comparing said sense voltage and said threshold voltages and generating said cycling signals for cycling said switch means and said switchable resistor means, and said means for changing the amplitude of said threshold signals comprises circuit means for changing the level of said reference voltage inversely with changes in said drive voltage.

7. A constant energy drive circuit in accordance with claim 6 in which said circuit for supplying a reference voltage to said switchable resistor is a series regulator operable for altering said reference voltage inversely with changes in said drive voltage.

8. A constant energy drive circuit in accordance with claim 7 in which said series regulator includes an operational amplifier.

9. A constant energy drive circuit in accordance with claim 6 in which said switchable resistor means comprises a resistance network having connections with said circuit means for supplying said reference voltage and with a reference signal input to said comparator circuit, said resistance network further having a branch resistance connected in a feedback circuit to the output of said comparator circuit, said feedback circuit further comprising a threshold control switch responsive to said cycling signals supplied to said output by said comparator circuit for cyclically altering the connection of said branch resistance within said resistance network.

10. A constant energy drive circuit in accordance with claim 9 in which said resistance network is a voltage divider network connected between said reference voltage and ground, said voltage divider network having an above ground junction with said branch resistance and said reference signal input of said voltage comparator, and said threshold switch in said feedback circuit is operable by said cycling signals from the output of said comparator for cyclically connecting said branch resistance to ground whereby said resistance network is switchable between two resistance levels.

11. A constant energy drive circuit in accordance with claim 10 which said threshold control switch is a transistor for connecting said branch resistance to ground.

12. A constant energy drive circuit for an electromagnet comprising a coil switch means having an open and a closed state for operatively connecting an unregulated source of drive voltage in circuit with said coil, current sense means for providing a sense signal the level of which is indicative of the level of the current in said coil, means for enabling said switch means to a closed state in response to a turn on signal having a fixed time duration, and means activated at a preset level of said sense signal for cycling said switch means between said closed and open states and for adjusting the cycling rate to compensate for changes in said drive voltage.

13. A constant energy drive circuit in accordance with claim 12 in which said means for cycling comprises chopping circuit means activated initially at a preset level of said current in said coil for cycling said switch means to maintain an average peak current in said coil for at least a portion of the remainder period of said time duration and, means associated with said chopping circuit means for changing the rate of cycling of said switch means in response to changes in said drive voltage to vary the average peak current in said coil during said remainder period to compensate for changes in total energy applied during said time duration to said coil by said source of drive voltage.

* * * * *